US006126261A

United States Patent [19]

Yamanaka

[11] Patent Number: 6,126,261

[45] **Date of Patent: *Oct. 3, 2000**

[54] IMAGE RECORDING APPARATUS AND METHOD, RECORDING HEAD AND CIRCUIT FOR DRIVING SAME

[75] Inventor: Akihiro Yamanaka, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/456,726

[22] Filed: Jun. 1, 1995

[30] Foreign Application Priority Data

Jun. 1, 1994 [JP] Japan ..... 6-120003

[51] Int. Cl.[7] ..... B41J 29/38

[52] U.S. Cl. ..... 347/12; 347/37

[58] Field of Search ..... 347/9, 12, 13, 347/40, 42, 180, 181, 182, 37, 41

[56] References Cited

U.S. PATENT DOCUMENTS

| | | | |
|---|---|---|---|
| 4,395,720 | 7/1983 | Grover et al. | 347/12 |
| 4,956,648 | 9/1990 | Hongo | 3473/19 |
| 5,075,701 | 12/1991 | Arai | 347/210 |
| 5,142,296 | 8/1992 | Lopez et al. | 347/12 |
| 5,357,268 | 10/1994 | Kishida et al. | 347/13 |
| 5,359,355 | 10/1994 | Nagoshi et al. | 347/9 |
| 5,412,406 | 5/1995 | Fujimoto | 347/180 |
| 5,512,922 | 4/1996 | Paton | 347/12 |

FOREIGN PATENT DOCUMENTS

| | | |
|---|---|---|
| 0396982 | 11/1990 | European Pat. Off. . |
| 0518670 | 12/1992 | European Pat. Off. . |
| 0562477 | 9/1993 | European Pat. Off. . |

*Primary Examiner*—N. Le
*Assistant Examiner*—Craig A. Hallacher
*Attorney, Agent, or Firm*—Fitzpatrick, Cella, Harper & Scinto

[57] ABSTRACT

A high-quality image conforming to the scanning speed of a recording head can be recorded through a simple arrangement in which 128 recording elements (segments) are divided up into eight blocks (each block comprising 16 segments). In order to perform recording by the initial block, a code of the corresponding three bits is supplied to a 3to8 decoder, whereupon a signal BE1 is outputted to made segments 1, 2, 17, 18, . . . , 113, 114 the object of drive. When a signal ODDENB attains a high level, segments 1, 17, . . . , 113 are driven and dots are formed at recording column positions by each segment. By subsequently sending a signal EVENENB to the high level, segments 2, 18, . . . , 114 are driven. Here the interval between the signals ODDENB and EVENENB is changed in conformity with the scanning speed of the recording head.

27 Claims, 17 Drawing Sheets

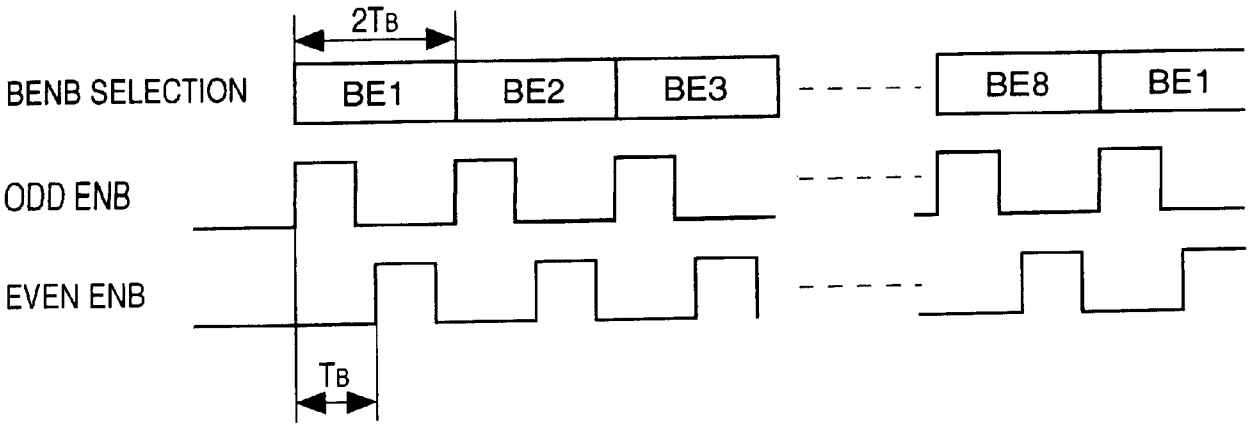
FIG. 2A
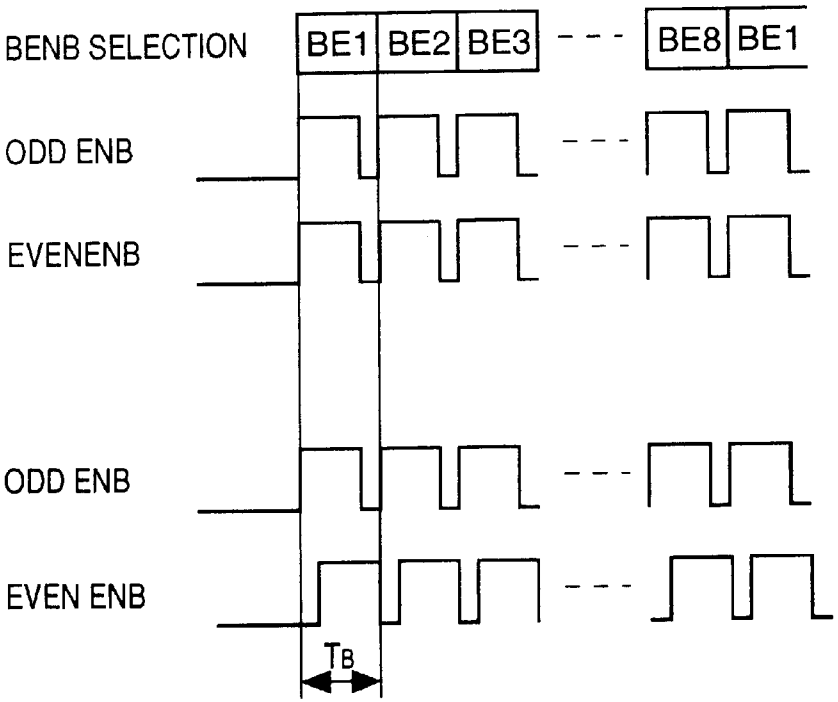
FIG. 2B
FIG. 2C

FIG. 16

| | | | | | | | |
|---|---|---|---|---|---|---|---|
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |

IMAGE RECORDING APPARATUS AND METHOD, RECORDING HEAD AND CIRCUIT FOR DRIVING SAME

BACKGROUND OF THE INVENTION

This invention relates to a recording apparatus and method, a recording head and a circuit for driving the recording head. More particularly, the invention relates to an apparatus and method, in which an image is recorded by causing a recording head to perform scanning motion, the recording head and a circuit for driving the recording head.

In a head having a number of recording elements, generally the recording elements are divided into a plurality of blocks and the blocks are driven in time-sharing fashion. The reason for this is that such a method of drive reduces the number of recording elements that are driven simultaneously. As a result, there is a smaller voltage drop in common wiring, which voltage drop is attendant upon a decrease in current value. In addition, a smaller power supply capacity is sufficient. Furthermore, in an ink-jet printer, mutual pressure interference (crosstalk) between nozzles serving as the recording elements can be reduced.

FIG. 8 is a block diagram of a circuit arrangement which uses such driving by time division. An M-bit driver is a functional element that controls passage of current to the recording elements, where M corresponds to the number of nozzles. An M-bit shift register is a circuit in which image data is arranged and stored in correspondence with the recording elements. Image data on a signal line S_IN which arrives in synchronization with an image-data transfer clock SCLK enters the shift register. When M-bit data is transferred, a LAT signal is supplied, whereby an M-bit latch latches the M-bit data that has been stored in the M-bit shift register.

The M-bit data is inputted into AND gates, which take the logical product between this data and block-enable selection signals BE1~BEN of N bits from the M-bit driver. More specifically, by applying drive signals divided in terms of time to the block-enable selection signals BE1~BEN, time division on the basis of division by N can be achieved.

In a case where the number of time divisions is large, it is known to provide a block-enable selection decoder in order to reduce the number of block selection signals. In a case where N is set as the simultaneous drive number with respect to the number M of nozzles, an arrangement can be adopted using a block-enable selection decoder having an M/N-bit output. The relation between the value of M/N and the number X of terminals of the blockenable selection decoder is as follows in terms of the decoder construction:

$$\text{number of time divisions } NN=M/N=2^x$$

The number of enable terminals can be reduced from M/N to X.

FIG. 7 illustrates an example of a case in which the number of time divisions (the number of blocks) is 16. A head having 128 nozzles is divided into 16 blocks (BE1~BE16) by a 4to16 decoder using signals A~D of four input bits. By entering a nozzle drive signal HENB besides BE1~BE16, the degree of freedom of the driving waveform is raised. The signals BE1~BE16 and HENB are supplied to segments (nozzles), shown in FIG. 8, by AND gates that take the AND with image data stored by a latch circuit. By virtue of this block-enable selection decoder, 16 drive signals that were required can be reduced to five drive signals.

However, when a head having nozzles arranged on the same straight line is driven by time division block by block, the carriage mounting the recording head is moved in the scanning direction, as a result of which the dot-impact positions are shifted. This shift or deviation in dot-impact position caused by time division is a problem particularly in a head having a large number of time divisions, such as a head having the above-mentioned block-enable selection decoder.

Accordingly, successively dispersed drive disclosed in Japanese Patent Publication No. 3-208656 has been proposed. According to this drive, the deviation in printing caused by time division is eliminated by tilting the head.

This will be described with reference to FIG. 9. This illustrates an example of successively dispersed drive in a case where the number N of time divisions is 16.

In FIG. 9, the bold line indicates the tilt of the recording head. The numerals inside the circles indicate the numbers of nozzles which discharge ink drops that impact at these positions.

The 1st through 16th nozzles corresponds to a first group, the 17th through 32nd to a second group, and the 33rd through 48th to a third group. There are eight groups in all (for a total of 128 nozzles).

The leading nozzle (17th nozzle) of the second group is situated above the immediately preceding vertical column of dots with respect to the leading nozzle (first nozzle) of the first group. Similarly, the leading nozzle (33rd nozzle) of the third group is situated above the column two columns ahead with respect to the leading nozzle of the first group. In other words, each group is so arranged as to record dots (16 dots in this case) on the preceding column with respect to the preceding group.

Accordingly, in a case where an image is recorded by causing the head to perform scanning motion, the second group records an image of (n−1)th columns while the 16 nozzles of the first group are recording an image of an n-th column from the beginning of a band image. Similarly, the third group records an image of the (n−2)th column.

This will be described in greater detail. As shown in the timing chart of FIG. 9, the leading nozzle of the first group and the leading nozzle of the second group (and of the 3rd through 8th groups) are driven at the same time, after which the succeeding nozzles are driven in order, i.e., in the order of the second nozzle, third nozzle of each group and so on. Hereinafter, a set of nozzles driven simultaneously will be referred to as "block".

Accordingly, a binary signal for driving the recording head in this case sets 16 bits in a different vertical column group by group.

This recording head is attached at an inclination θ with respect to the carriage scanning direction. The value of θ is defined as follows:

$$\theta=\arctan(1/16)=3.6^\circ$$

which depends upon the nozzle interval (16 in FIG. 9) at which nozzles are driven at the same time. (The dot interval in the horizontal direction is assumed to be equal to the dot interval in the vertical direction.) The optimum block interval in this case (the maximum block interval of time division) is given by the following equation:

$$TB=T/NN \quad (1)$$

where T represents the drive period (the time required for drive of all nozzles to be completed) and NN is the number of time divisions.

More specifically, if the block interval (ENB signal interval) is TB, as shown in FIG. 9, a printing deviation caused by time division will be eliminated since the head is tilted by the amount of the shift in impact position owing to time division. In such successively dispersed drive, there is no deviation in printing caused by time division. Therefore, it is desired that the number of time divisions be as large as possible. In general, the number of input signals necessary for time division is reduced by the block-enable selection decoder, etc.

Many recording apparatus such as printers having a variety of printing speed modes. For example, a portable printer generally has three types of printing speed modes, namely HQ (high quality), HS (high speed) and battery drive. Consider the number of time divisions when the drive frequency for HQ is 5 kHZ (period T=200 $\mu$s), the drive frequency for HS is 10 kHZ (period T=100 $\mu$s) and the drive frequency for battery drive is 2.5 kHZ (period T=400 $\mu$s).

If the necessary driving pulse width of the head (the minimum pulse width that must be provided) is 10 $\mu$s, the maximum number of time divisions in the above-mentioned modes is 20 for HQ, 10 for HS and 40 for battery drive, based upon Equation (1).

In this case, the number of time divisions with the conventional circuit arrangement of the kind shown in FIG. 7 is ten for the HS mode, which has the smallest number. (The reason for this is that if the number of time divisions exceeds ten, the necessary driving pulse width 10 $\mu$s of the head cannot be satisfied in the HS mode.)

Consequently, the merits of time-division drive mentioned above diminish. In particular, in battery drive, the design must be such that four times as much instantaneous current will flow in comparison with a circuit for which the number of time divisions is 40.

Similarly, in a case where the same head is used in a variety of recording apparatus, the necessary printing frequency differs depending upon the particular application but the number of time divisions of the head must be decided while assuming the highest printing drive frequency.

Therefore, since the simultaneous drive current becomes large, the common wiring must be widened in order to reduce the voltage drop and the number of contact terminals must be increased. Furthermore, it is necessary to enlarge the capacity of the power supply. The result is a larger apparatus and a rise in cost.

In successively dispersed drive, the inclination of the head must be enlarged if the number of divisions is small. In a recording apparatus of the exchangeable head type, therefore, it is difficult to achieve contact between the head and apparatus. Consequently, there is a decline in contact reliability and a complex contact design is required.

Usually, the same head is made to perform printing at various drive frequencies depending upon the printing mode and printing apparatus. However, in a head having a block-enable selection decoder, the number of time divisions must be decided upon assuming the highest printing frequency. Another problem is that "shifted time-division drive" cannot be carried out.

SUMMARY OF THE INVENTION

Accordingly, an object of the present invention is to provide a recording apparatus and method, a recording head and a drive circuit therefor, in which a high-quality image conforming to the scanning speed of the recording head can be recorded through a simple arrangement.

According to the present invention, the foregoing object is attained by providing a recording apparatus in which a plurality of recording elements arranged at a prescribed angle of inclination are divided into groups the number of which conforms to a number of recording column positions in a sub-scan direction, dots corresponding to respective recording column positions are recorded in each group and a recording head having a plurality of recording elements is moved in a main-scan direction to record an image in band units, the apparatus comprising signal supply means for supplying a plurality of drive signals which specify each unit of drive, where a block of recording elements constituted by recording elements in the same phase in each group is adopted as one unit of drive, and means for changing a time difference between the drive signals, which are supplied by said signal supply means, upon making the time difference dependent upon scanning speed of the recording head.

In accordance with a preferred embodiment of the invention, the drive signals desirably are constituted by a first signal corresponding to a unit of drive composed of a block of odd-numbered recording elements in each group and a second signal corresponding to a unit of drive composed of a block of even-numbered recording elements in each group. As a result, since time differences at which these two signals are supplied are capable of overlapping each other, higher speed movement of the recording head can be followed up and a high-quality image can be recorded.

It is preferred that the scanning speed of the recording head be set externally. If this arrangement is adopted, it will be unnecessary to make any changes on the side of the apparatus that is the origin of the transfer of the image to be recorded. This also allows the operator to make any desired setting.

It is preferred that the recording elements be elements which jet ink drops by thermal energy. This will make it possible to greatly reduce the spacing between recording elements so that a high resolution can be obtained.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 2A to 2C are diagrams showing the drive timing in each mode according to the first embodiment;

FIG. 16 is a diagram showing a mask pattern used in the first embodiment;

DESCRIPTION OF THE PREFERRED EMBODIMENTS

Figure 1:
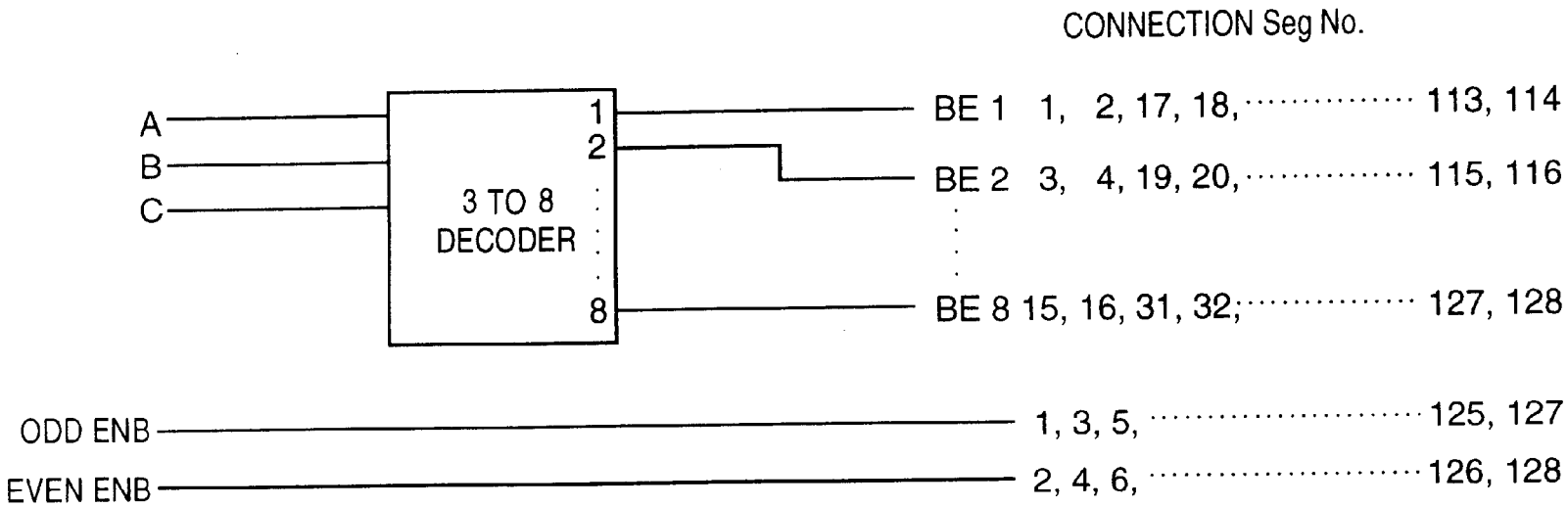
FIG. 1 is a diagram showing a circuit arrangement according to a first embodiment of the present invention.

Embodiments according to the present invention will now be described in detail with reference to the accompanying drawings.

A printing operation according to a general embodiment will be described with reference to FIG. 10.

The segments (nozzles) of the printing head, or the printing head itself, are inclined at a prescribed angle (3.6° with respect to the vertical direction in this embodiment). As a result (which depends also upon the segment spacing), the segment array (128 nozzles) span eight columns perpendicular to the head scanning direction, as shown in FIG. 10. More specifically, when the segment at the beginning of a first group (segments 1~16) operates at a timing for recording an n-th column of dots, the segment (segment 17) at the beginning of the second group is at a timing for recording an (n−1)th column of dots. Similarly, the timings of the leading segments of the third through eighth groups are arranged so that these segments perform recording simultaneously. After the head segments in each group are driven, the head is moved a very small distance and the second segments of respective groups (segments 2, 18, . . . ) are driven simultaneously. In other words, rather than one column of 128 dots being printed using the 128 segments, portions equivalent to a plurality of columns are printed. (Each portion indicated by the bold black line in FIG. 10 is equal to 16 dots.) It should be noted that the spacing between the columns and direction in which the segments are arrayed are shown in exaggerated form; in actuality, the spacing and angle of inclination are very small.

Figure 10:
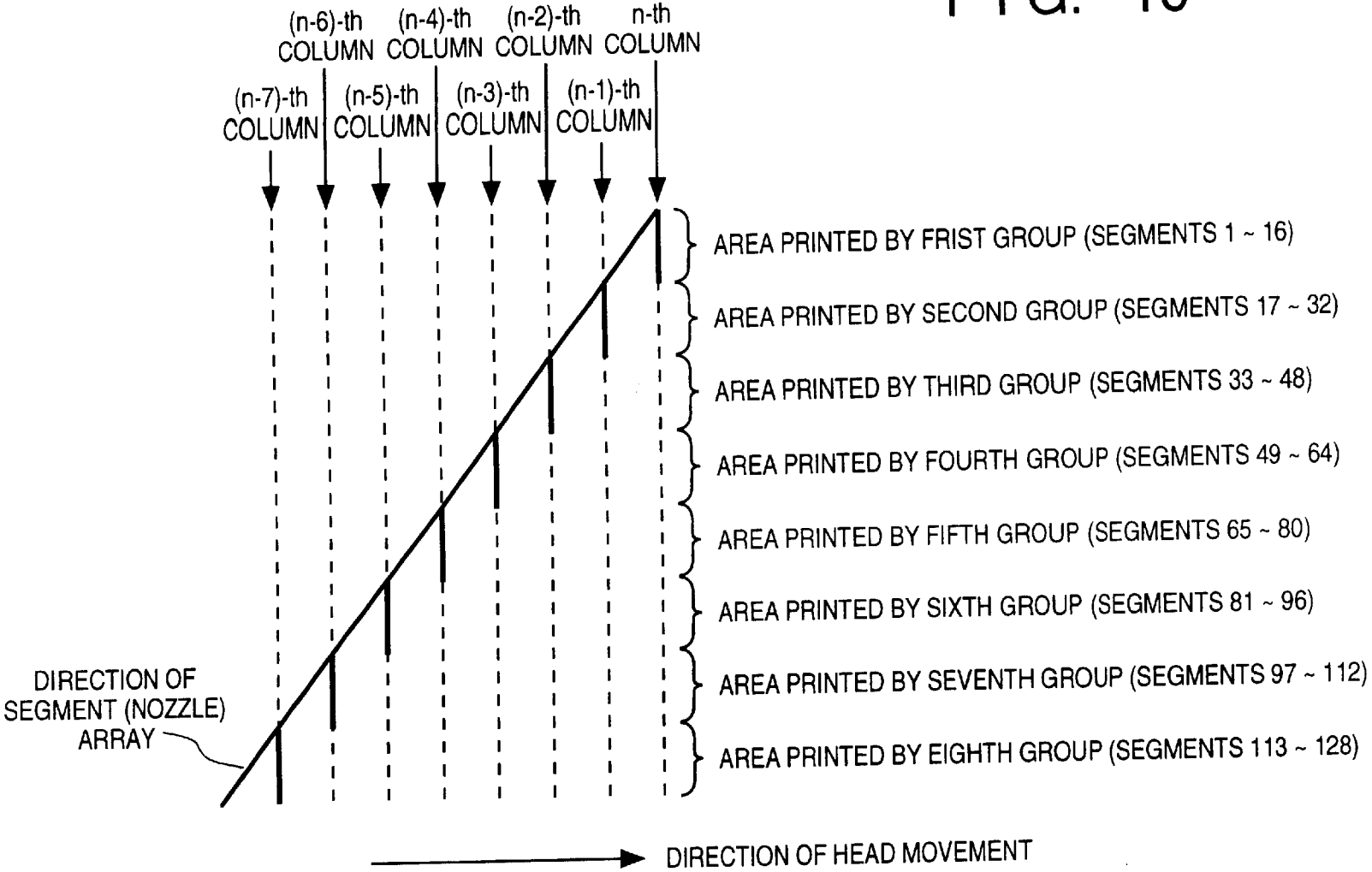
FIG. 10 is a diagram showing the relationship between the recording head and recording area in a general embodiment.

Further, in FIG. 10, the first segments of respective groups are driven simultaneously, then the second segments of respective groups are driven, by way of example. More specifically, segments 1, 17, 33, . . . , 114 are driven simultaneously, and segments 2, 18, 34, . . . , 116 are driven at the next timing instant. Segments driven simultaneously shall be referred to as a "block" below.

FIRST EMBODIMENT

Figure 9:
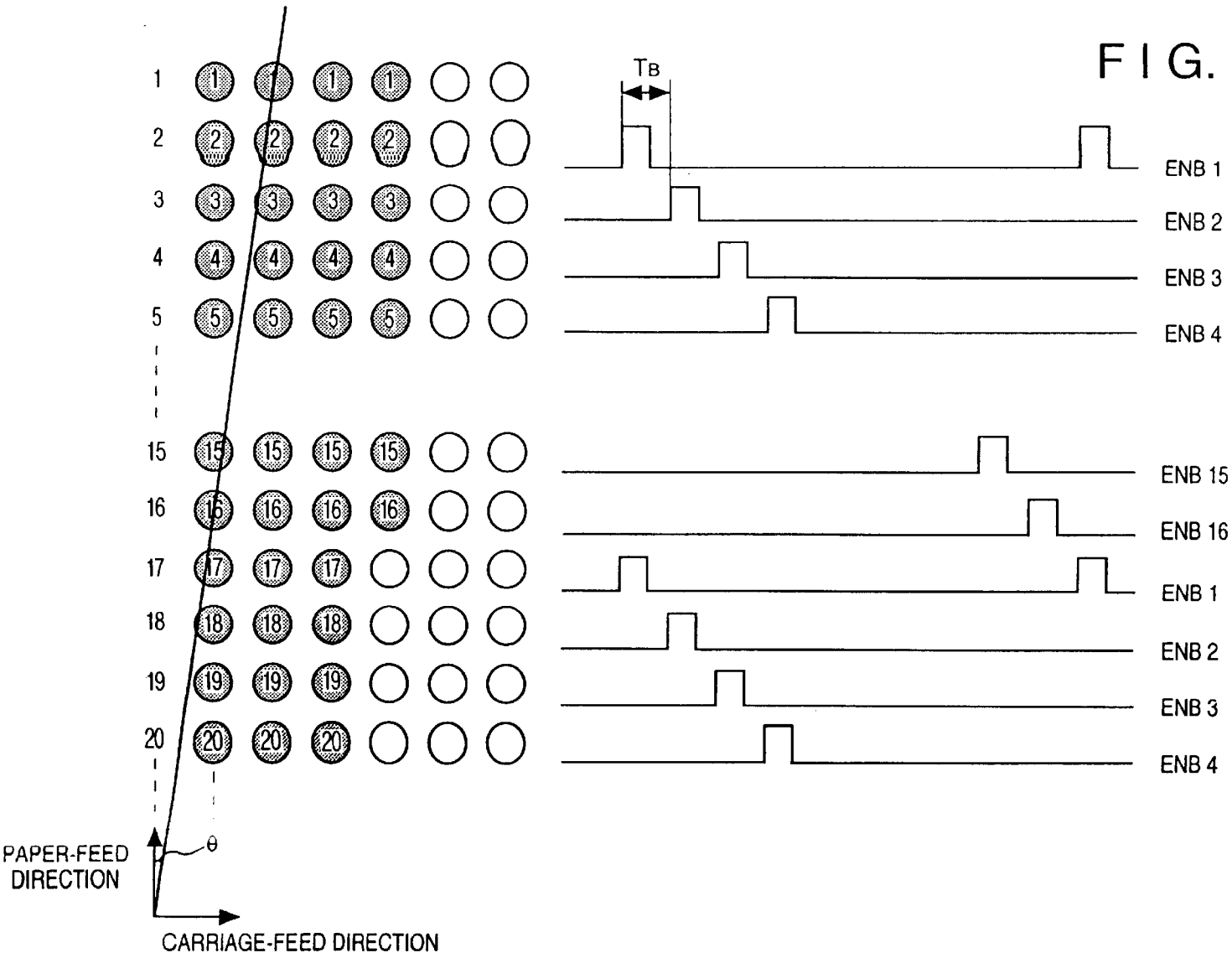
FIG. 9 is a diagram showing printing timing in a case where a recording head is inclined in the prior art.

FIG. 1 is a block diagram showing the circuit arrangement according to a first embodiment of the present invention. In this embodiment, a head composed of 128 nozzles is so arranged that time-division drive is carried out by a 3to8 decoder and signals ODDENB and EVENENB. The signal lines are connected to the segments shown in FIG. 1 via an AND operation with an image data signal. In this embodiment, the relation between the recording head and printing dots is as illustrated in FIG. 9 or FIG. 10.

FIG. 2A is a timing chart for a case in which drive is performed at a low driving frequency. Selection of block enable signals is carried out successively from BE1 to BE8 by input of A, B, C as shown in FIG. 1. The interval of the block enable signals is ($2*T_B$) in successively dispersed drive (where $T_B$=T/16). Signals ODDENB and EVENENB are outputted at the block interval of $T_B$ during the time that each block enable signal is outputted. As a result, initially signals BE1, ODDENB and EVENENB are outputted at the block interval $T_B$. Initially, therefore, segments (nozzles) selected by the AND between BE1 and ODDENB, namely the segments Seg 1, 17, 35, . . . 113, are outputted, and segments selected by the AND between BE1 and EVENENB, namely Seg 2, 18, 36, . . . 114, are outputted after a delay of time $T_B$.

Next, segments selected by the AND between BE2 and ODDENB, namely the segments Seg 3, 19, 37, . . . 115, become the object of drive after the time delay $T_B$, and then the segments Seg 4, 20, 38, . . . 117 become the object of drive owing to BE2 and EVENENB at the next timing instant. Finally, segments selected by the AND between BE8 and EVENENB are outputted in similar fashion. The cycle returns to the segments selected by the AND between BE1 and ODDENB after the time delay $T_B$ and operation is repeated in similar fashion.

In other words, since Seg 1~Seg 16 are each driven upon being successively delayed by $T_B$, the number of time divisions is 16. By inclining the head at an angle of 3.6°, it is possible to perform successively dispersed drive with the aforementioned deviation in impact position caused by driven identical with that of FIG. 9.

FIGS. 2B and 2C are timing charts for a case in which drive is performed at a high driving frequency. Block enable signals are successively selected from BE1 to BE8, in the same manner as in FIG. 2A, but the interval of the block enable signals is different from that of FIG. 2A. In drive according to FIG. 2B, ODDENB and EVENENB are outputted simultaneously during the time that each block enable signal is outputted. That is, since Seg 1 and 2, Seg 17, 18, . . . , 113, 114 are driven simultaneously, the number of time divisions is eight. In this case, since the interval between nozzles driven simultaneously is 16, the angle of inclination is 3.6°. However, since two mutually adjacent segments are driven simultaneously, a slight deviation in impact position ascribable to drive occurs in a case where successively dispersed drive is performed. (The value of the positional deviation is pitch * 1/16 in the scanning direction.) However, a value on this order leads to no substantial problems.

FIG. 2C is a time chart for a case in which "shifted time-division drive" is carried out to reduce this deviation in impact position. The time shift between ODDENB and EVENENB is the maximum "$T_B$−drive pulse width".

The present invention will be compared with the prior art taking an actual recording apparatus as an example. The recording apparatus has a head composed of 128 nozzles, the HQ mode of driving frequency 6.25 kHZ (period T=160 μs) and the HS mode (alternatively driving even/odd-numbered recording elements) of driving frequency 12.5 kHZ (period T=80 μs), and a required driving pulse width of 10 μs [the apparatus (a) in the table below].

TABLE 1

| APPARATUS | DRIVE FREQUENCY (kHZ) HQ | HS | MAXIMUM TIME DIVISIONS HQ | NUMBER OF DIVISIONS HS | PRIOR ART | THIS INVENTION TIME DIVISIONS | INCLINATION |
|---|---|---|---|---|---|---|---|
| (a) | 6.25 | — | 16 | — | TIME DIVISIONS = 8 | 16 | 3.6° |
| (b) | 6.25 | 12.5 | 16 | 8 | INCLINATION = 7.2° | 16/8 | |
| (c) | 12.5 | — | 8 | — | | 8 | |

(*Number of head nozzles is 128, required driving pulse width is 10 μs)

When maximum number of time divisions in case of successively dispersed drive is computed from Equation (1), we have 16 for the HQ mode and 8 for the HS mode. In the embodiment of this invention, the HQ mode can be realized in the drive of FIG. 2A and the HS mode can be realized in the drive of FIG. 2B by inclining the head at an angle of 3.6°. Maximum current which flows at this time is a current that drives 128/16=8 recording elements in the HQ mode and a current that drives (128/2)/8=8 recording elements in the HS mode. (Since alternate drive of even/odd-numbered recording elements is carried out, the number of nozzles driven in one period is 128/2). If an attempt is made to accomplish this with the conventional circuit, the number of time divisions will be eight (the number of nozzles driven simultaneously will be 16) and the head inclination will be 7.2°.

The reason that eight nozzles are simultaneously driven in both HQ and HS modes will be explained with reference to FIGS. 13A and 13B.

Figure 13A:
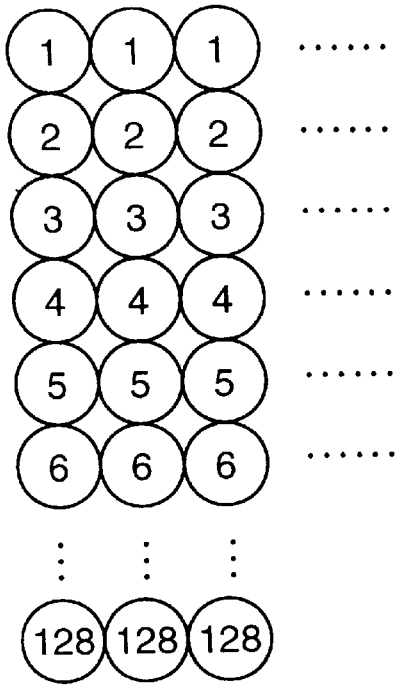
FIGS. 13A and 13B are diagrams showing print pixels respectively in HQ mode and HS mode.

FIG. 13A shows pixel positions printed by the respective recording elements in the HQ mode. FIG. 13B shows pixel positions printed by the respective segments in the HS mode. In the HS mode, to raise printing speed, the interval between dots is double of that in the HQ mode, and dot arrays printed by odd-numbered nozzles and dot arrays printed by even-numbered nozzles alternate with each other. Note that FIG. 13B shows printed result, and actual head drive is made by the above-described driving processing.

Figure 14:
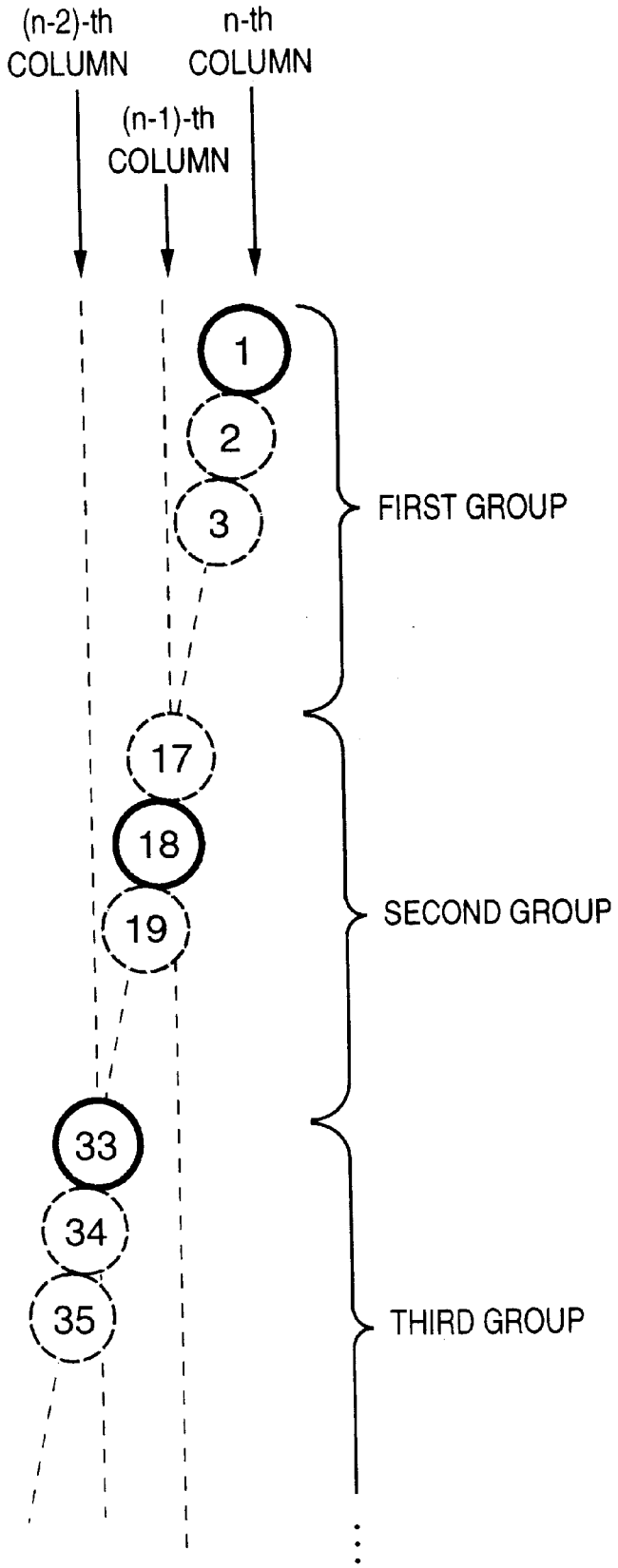
FIG. 14 is a diagram showing the principle of HS mode printing.

FIG. 14 shows driving of the segments of the recording head when a signal BE1 is at a high level in the HS mode. As shown in FIG. 1, when the level of the signal BE1 becomes "high", the segments Seg 1, 2, 17, 18, . . . 113, 114 of the 128 segments are activated. As shown in FIG. 10, the segments Seg 1 and 2 belong to the first group, the segments Seg 17 and 18, the second group, and the segments Seg 113 and 114, the eighth group.

For example, in FIG. 14, the first block segment is driven. In the first group, the segment Seg 1 is driven; in the second group, the segment Seg 18 is driven; and in the third group, the segment Seg 33 is driven. One segment is driven only when the recording head moves in the main-scan direction by two columns. Even if the speed of moving the recording head become double of that in the HQ mode, recording is possible at the same one-segment drive period.

In FIG. 14, a solid-line circle represents a driven segment, and a broken-line circle, a non-driven segment.

Figure 13B:
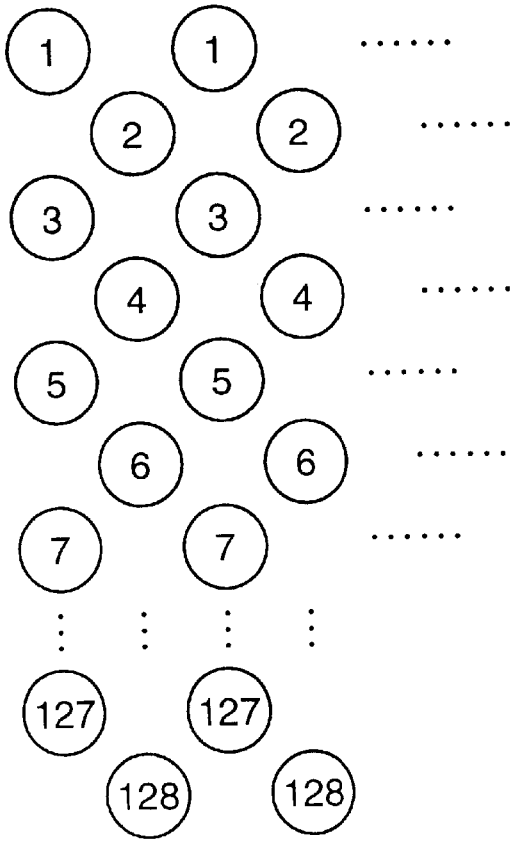

In this embodiment, in the HS mode printing processing, bitmap image data is masked with a mask pattern as shown in FIG. 16 and a bitmap image (logical product) is generated for the printing as shown in FIG. 13B.

As a result, in the HS mode, the number of segments to be driven is also eight.

That is, according to this embodiment, the number of nozzles driven simultaneously can be made eight. This makes it possible to design for the voltage drop and power supply accordingly. As a result, the recording apparatus can be made small in size and low in cost. Furthermore, since a head inclination of 3.6° is sufficient, there is no decline in reliability in a recording apparatus of the exchangeable head type and there is no need for a complicated contact design.

Similarly, in a case where the same head is used in a plurality of recording apparatus, the present embodiment is such that the number of time divisions can be changed in conformity with the apparatus requirements, as shown in Table 1. Therefore, an optimum design can be achieved in which more than the necessary parts are not needed to achieve conformity with the head on the apparatus side.

In particular, since it suffices merely to add on only the two signal lines ODDENB, EVENENB, the burden involved in circuit design is reduced.

Figure 11:
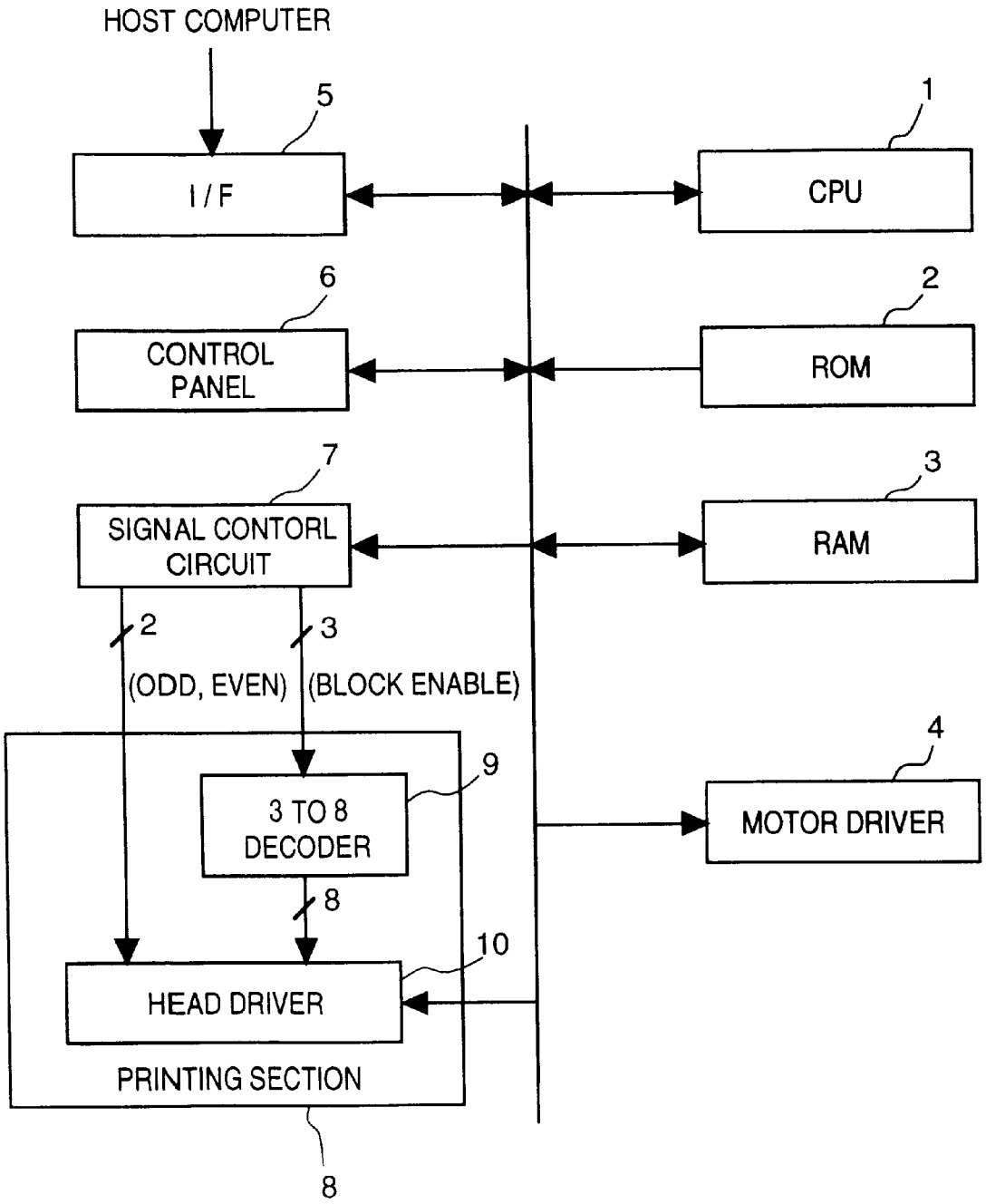
FIG. 11 is a block diagram showing a printing apparatus in the first embodiment.

FIG. 11 illustrates an example of the overall construction of the apparatus set forth above.

As shown in FIG. 11, the apparatus includes a CPU 1 for overall control of the apparatus, a ROM 2 storing the processing procedure of the CPU, font data and the like, and a RAM 3 used as the work area of the CPU1. The RAM 3 has a reception buffer area for temporarily storing received printing data, and an image buffer area for developing an image recorded by at least one scan of the recording head. The apparatus further includes a motor driver 4 for driving a motor (not shown) which scans a carriage (for mounting the recording head) and a motor (not shown) which conveys a recording medium (recording paper), an interface 5 for receiving printing data from a host apparatus (host computer), and a control panel 6 having various setting switches for setting on-line/off-line, the HQ mode or HS mode, etc., and a display device (constituted by an LED- or LCD-type display so that the currently prevailing mode can be visually confirmed). The apparatus is further provided with a signal control circuit 7 which, under the control of the CPU 1, generates a clock enable signal (three bits), an ODDENB signal and an EVENENB signal at the timings shown in FIG. 2, and a printing section 8. The latter has the 3to8 decoder shown in FIG. 1, as well as a head driver 10 for driving the recording head in accordance with the signals BE1~BE8, ODDENB and EVENENB. Data to be printed is transferred to the head driver in synchronization with a prescribed clock. In this embodiment, 128 bits of data are transferred but all 128 bits do not constitute the dot information of one vertical column to be printed; the bits are different for each block. The second block receives data of one vertical column of the immediately preceding position, and the third block, data of one vertical column immediately preceding the column printed by the second block.

The processing procedure of the CPU 1 is set in the signal control circuit 7 so as to generate an output timing of each signal in accordance with the mode designated by the control panel 6. Of course, the scanning speed of the recording head (the scanning speed of the carriage) also is controlled in dependence upon the HS or HQ mode, and therefore the motor driver 4 also is controlled.

Figure 15:
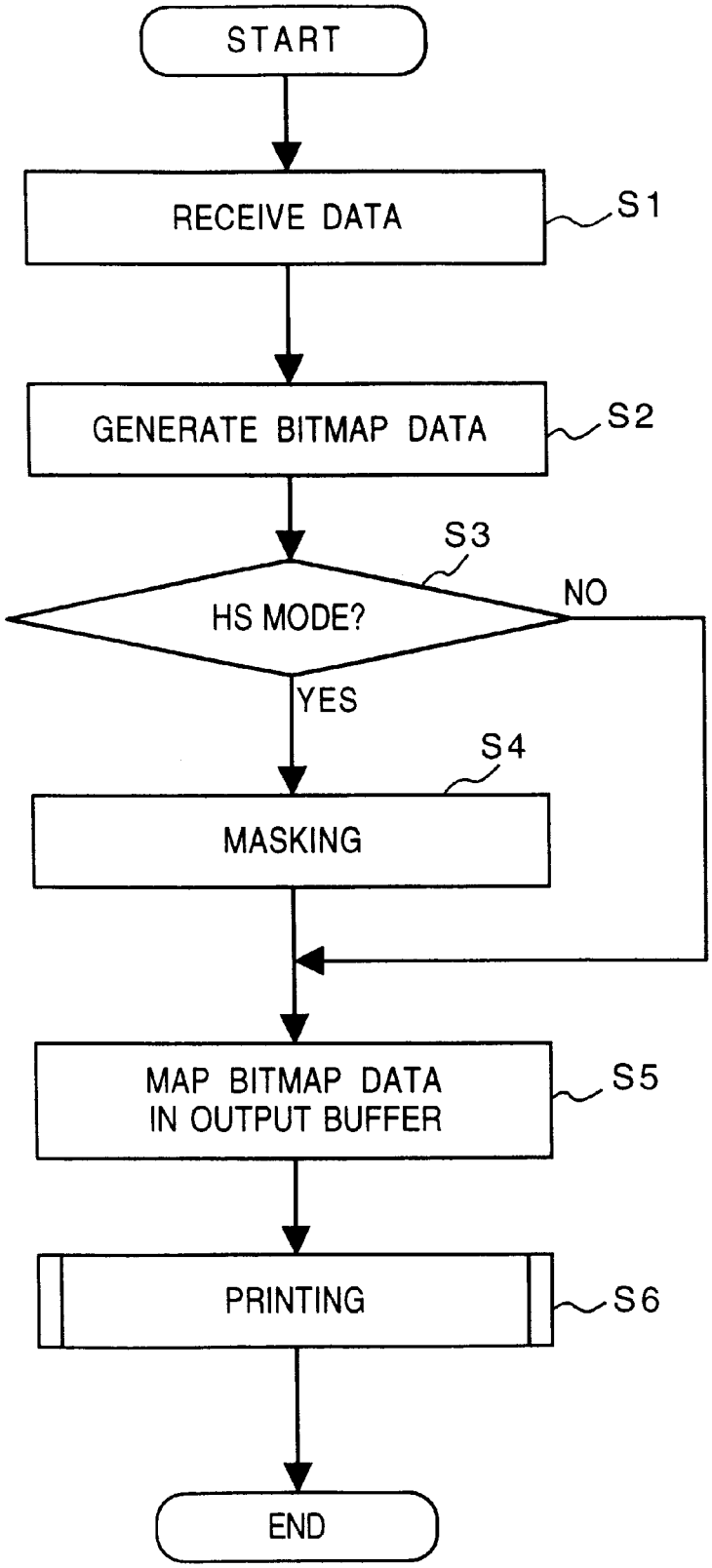
FIG. 15 is a flowchart showing a procedure of printing processing in the first embodiment.

Next, the printing processing in this embodiment will be described with reference to the flowchart of FIG. 15. Note that a program based on this processing is stored in the ROM 2. When a printing mode is designated from the operation panel 6, data indicative of the designated mode is stored into the RAM 3. The processing to set the printing mode using the operation panel 6 is merely storing data indicating the type of a set mode into the RAM 3, therefore, the explanation of this processing will be omitted.

When print data is received from the host computer as a higher-ranked external device in step S1, the received data is interpreted, and a bitmap data is generated for one scanning of the recording head in step S2. Then, in step S3, whether or not the current mode is the HS mode is determined. If NO, i.e., the current mode is the HQ mode, the process proceeds to step S5, in which the generated bitmap data is mapped in an output buffer ensured in the RAM 3 in advance, and in step S6, printing is performed.

On the other hand, if YES in step S3, i.e., the HS mode is set, the process proceeds to step S4, in which the bitmap data is masked with the mask pattern as shown in FIG. 16. In step S5, the masked bitmap data (logical product) is mapped in the output buffer, then in step S6, printing is performed based on the bitmap data.

Note that the printing in step S6 is made in accordance with the set mode.

As a result of the above processing, in the HS mode, only the dots as shown in FIG. 13B are subjected to printing.

Mode changeover may be performed not only by the control panel 6 but may be carried out also in a case where a prescribed command is received from a host apparatus. In the latter case, it would be required to provide the host apparatus with a menu screen display to select the printing mode in which printing is to be carried out, and with a program for outputting a command, which corresponds to the results of selection, to the present apparatus. On the other hand, in a case where setting is performed by the control panel on the side of the printing apparatus, the host apparatus need not be provided with the above-mentioned functions. (There are also cases in which these functions cannot be added on.)

In accordance with this embodiment, as described above, a decoder for selecting a block, which is a unit of drive, and an ODDENB signal and EVENENB signal for selecting recording elements of the same phase within the selected block are provided. Furthermore, the selection frequency of the block changed over by the decoder is adjusted in conformity with the traveling speed of the recording head, and the timings of the signals ODDENB, EVENENB are adjusted, thereby making it possible to record a normal, attractive image even while the same arrangement is used.

SECOND EMBODIMENT

In the first embodiment, in the HS mode, bitmap data used for printing is masked with the mask pattern shown in FIG. 16. That is, the bitmapping in the HQ mode differs from that in the HS mode. However, this does not pose any limitation upon the present invention.

Next, an example where bitmapping is made in the same manner regardless of printing mode will be described as a second embodiment.

Figure 17:
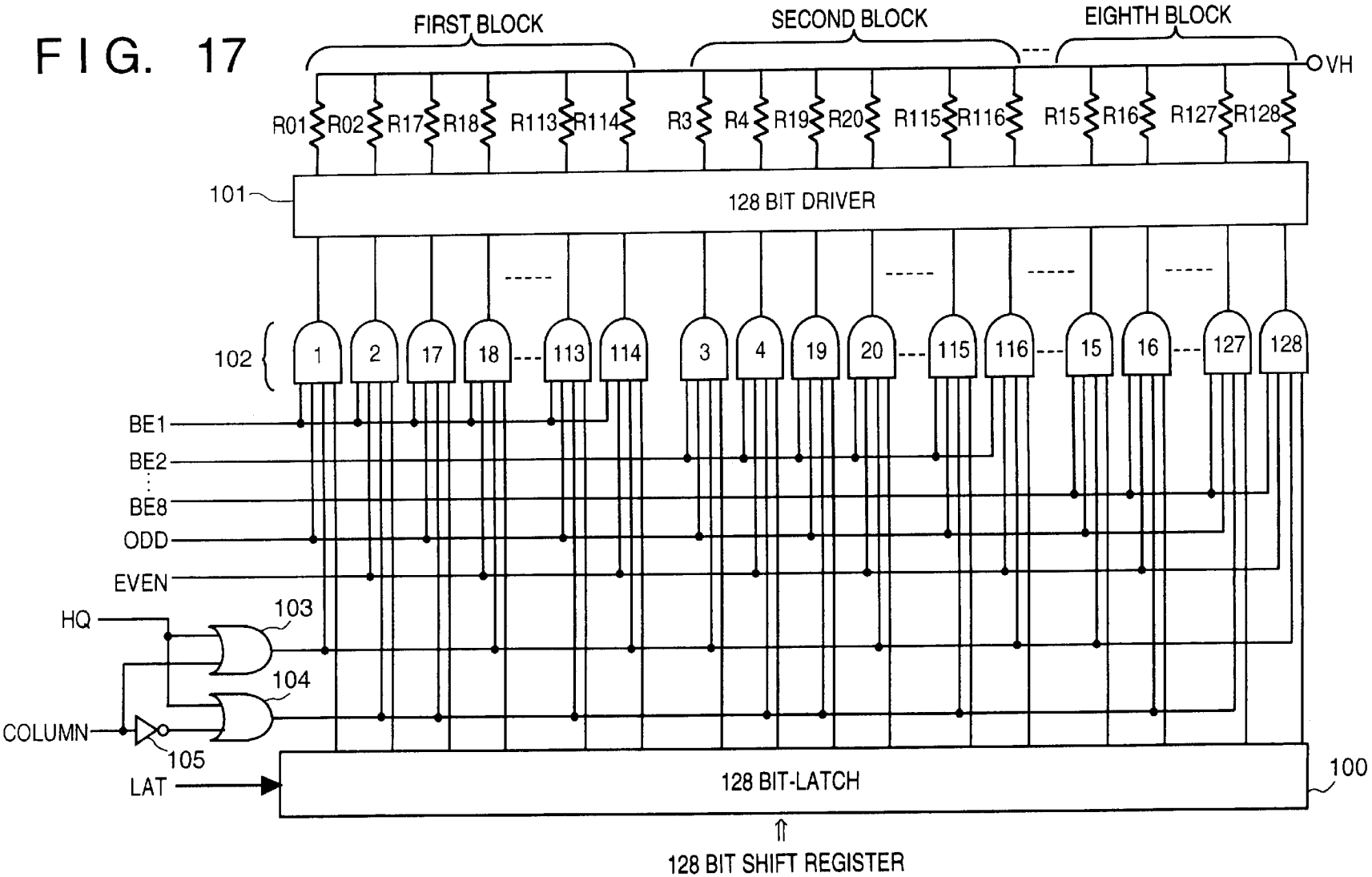
FIG. 17 is a diagram showing the recording head driver according to the second embodiment.

FIG. 17 shows an example of a driving circuit of the recording head according to the second embodiment. In FIG. 17, for the convenience of illustration, the segments of the recording head is aligned in block units. Actually, the segments are aligned in the group-unit order, i.e., Seg 1, 2, 3, 4, . . . 127, 128.

Figure 8:
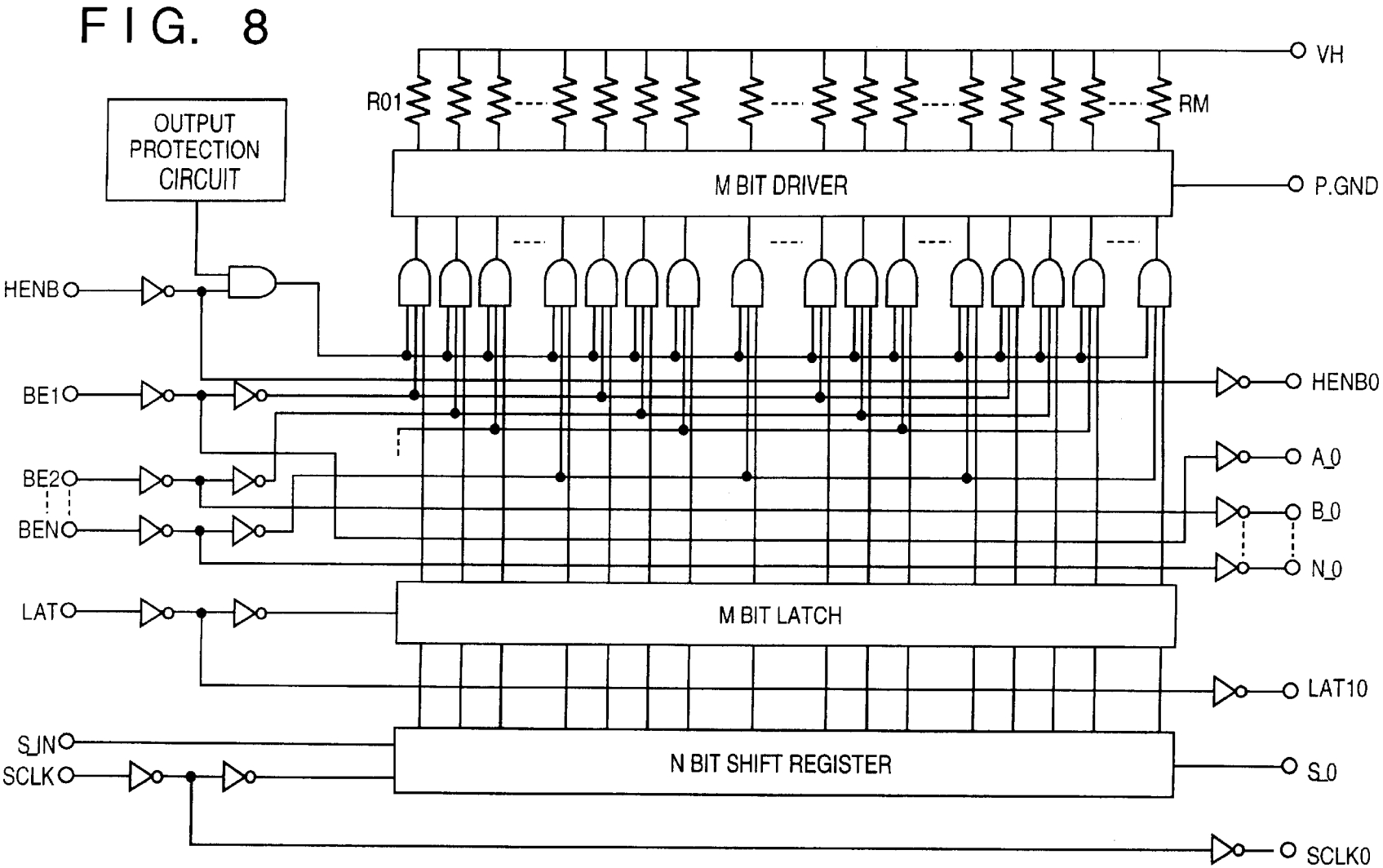
FIG. 8 is a diagram showing circuitry for driving a recording head.

In FIG. 17, a 128-bit latch 100 latches 128-bit data supplied from a circuit similar to the shift register in FIG. 8, and supplies the data to AND gates 102. When signals from the AND gates 102 are at a "high" level, a 128-bit driver 101 drives the corresponding segments. Numerals R01 to R128 denote thermal resistors. Note that the AND gates 102 respectively have the number of segment to drive.

The drive of segments is made such that each time the recording head moves in the main-scan direction by one recording column, a signal COLUMN is generated to select the segments to be driven in each group.

As shown in FIG. 17, signals BE1 to BE8 are supplied to the AND gates 102 of the first to eight blocks. Signals ODD are supplied to the AND gates corresponding to odd-numbered segments, signals EVEN, to the AND gates corresponding to even-numbered segments. Numeral 103 denotes an OR gate; and 105, an inverter.

Figure 18A:
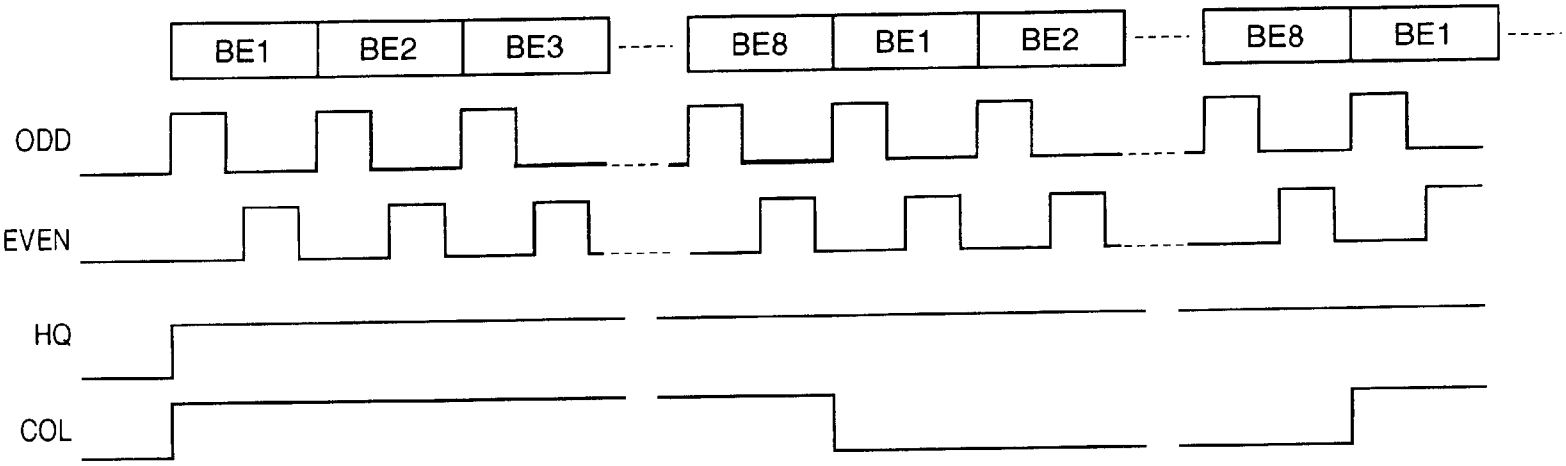
FIGS. 18A and 18B are diagrams showing driving timing of the circuit in FIG. 17.
Figure 18B:
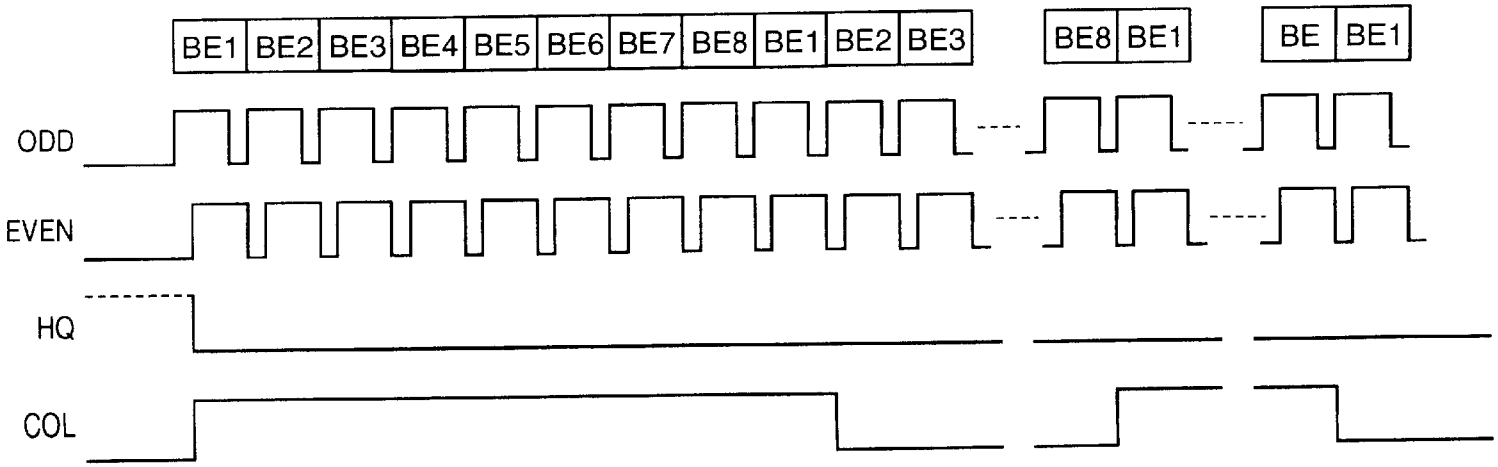

FIG. 18A shows printing timing in the HQ mode by the recording head having the above construction.

In the HQ mode, "high" level signals are supplied to each input terminal of the AND gates 102 since a signal HQ is at a "high" level, regardless of signal level of a COLUMN signal.

Accordingly, driving the recording head at drive timing as shown in FIG. 2A attains image printing as shown in FIG. 13A.

On the other hand, when the HQ signal is at a "low" level, i.e., the recording head is driven in the HS mode, the OR gates 103 and 104 supply signals dependent on the signal COLUMN to the AND gates 102. FIG. 13B shows drive timing at this time, the same as that in the first embodiment.

In the recording head having the construction in FIG. 17, when the logical level of the signal COLUMN is "high", "high" level signals are supplied to the AND gates corresponding to the segments Seg 1, 18, 33 of the first block, and "low" level signals are supplied to the AND gates corresponding to the segments Seg 2, 17, 34 . . .

When the recording head moves in the main-scan direction by one dot, "low" level signals are supplied to the AND gates corresponding to the segments Seg 1, 18 and 33, and "high" level signals are supplied to the AND gates corresponding to the segments Seg 2, 17, 34 . . .

Even if the recording head is driven at timing in FIG. 2B, the segments represented by the solid-line as shown in FIG. 14 are driven. This attains the image printing as shown in FIG. 13B.

Accordingly, in the HS mode, the number of the segments simultaneously driven at a point in time can also be eight.

Note that the signal COLUMN can be easily generated by providing a counter (4-bit output) for counting the signals BE1 to BE8 and utilizing the most significant bit of the output from the counter.

As described above, the second embodiment attains a similar advantage to that of the first embodiment. Note that in comparison with the first embodiment, the head driver has more circuits (gates) and more signal lines.

THIRD EMBODIMENT

Figure 3:
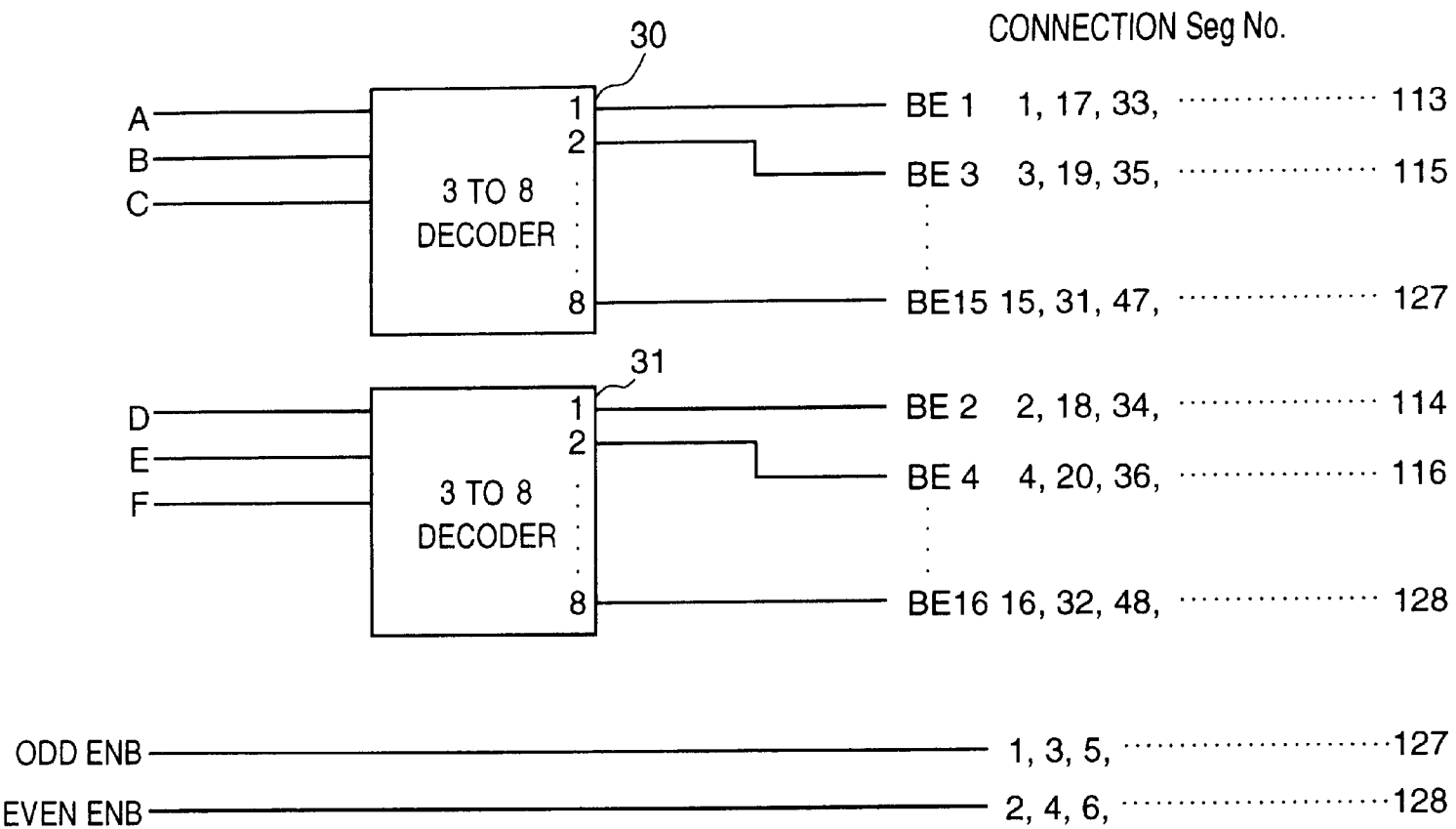
FIG. 3 is a diagram showing a circuit arrangement according to a second embodiment of the present invention.

FIG. 3 is a block diagram showing the circuit arrangement of principle portions according to a third embodiment of the invention. In this embodiment, two 3to8 decoders 30, 31 are provided, rather than one as in the first embodiment. Specifically, one decoder 30 is connected to odd-numbered segments and the other decoder 31 is connected to even-numbered segments. The segments to receive BE1 in the first embodiment are divided into two segment sections to receive BE1 and BE2 in this embodiment, the segments to receive the signal BE2 in the first embodiment are divided into two sections to receive BE3 and BE4 in this embodiment, and so forth, with the segments to receive BE8 in the first embodiment are divided into two sections to receive BE15 and BE16 in this embodiment.

The odd- and even-numbered segments corresponding to BE1–BE16 are selected and driven by ODDENB, EVENENB.

Figure 4A:
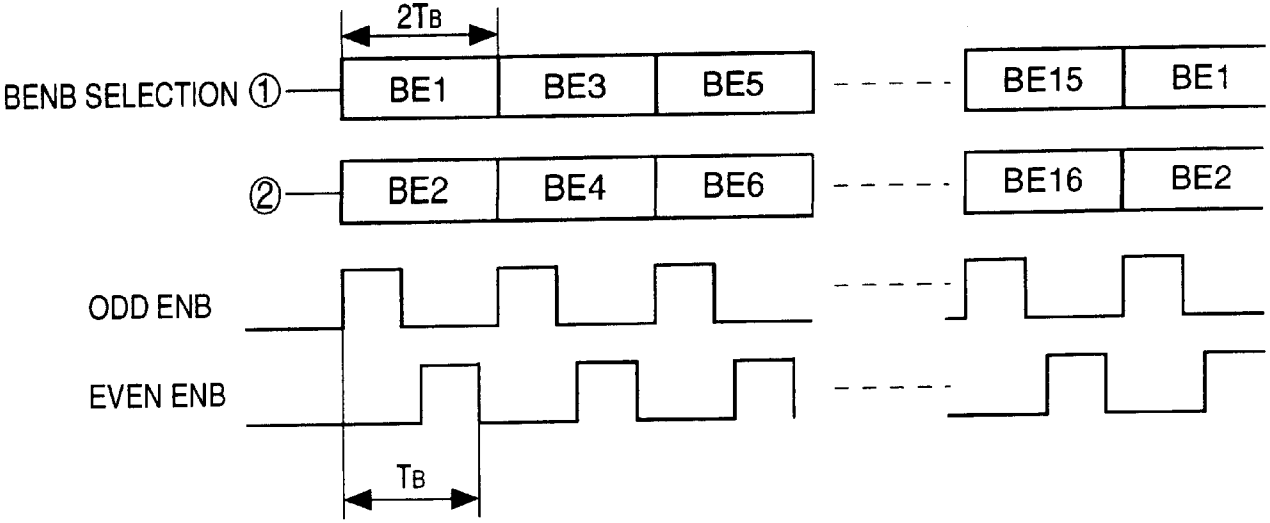
FIGS. 4A and 4B are diagrams showing the drive timings in respective modes according to the second embodiment.

FIG. 4A is a timing chart for a case in which drive is performed at a low driving frequency. The output timings of ODDENB and EVENENB are the same as shown in FIG. 2A. As for the timings at which the block-enable selection signals are outputted, BE1 and BE2 of FIG. 4 are outputted simultaneously at the timing at which the signal BE1 of FIG. 2A is outputted; BE3 and BE4 of FIG. 4 are outputted simultaneously at the timing at which BE2 of FIG. 2A is outputted, . . . ; and BE15 and BE16 of FIG. 4 are outputted simultaneously at the timing at which BE8 of FIG. 2A is outputted. More specifically, the printing operation is exactly the same as at low-frequency drive of the first embodiment, and successively dispersed drive without impact deviation can be performed at 16 time divisions by inclining the head at an angle of 3.6°.

Figure 4B:
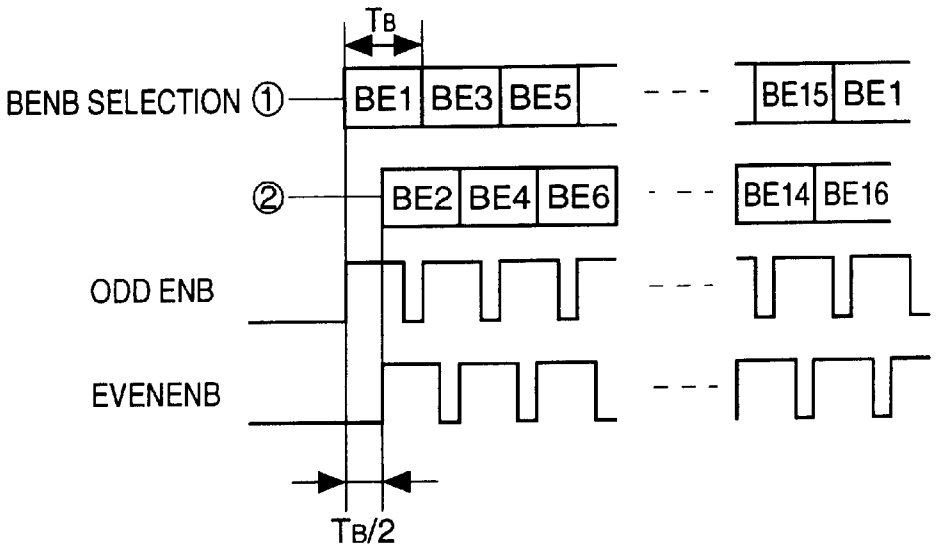

FIG. 4B is a time chart for a case in which drive is performed at a high driving frequency. In this embodiment, the output of the decoder 30 and the output of ODDENB are produced synchronously, and the output of the decoder 31 and the output of EVENENB are produced synchronously. At this time the block interval of each decoder output is $T_B$, and the block interval between the outputs of the decoders 30 and 31 is $T_B/2$. As a result, BE1–BE16 are each outputted upon been delayed by $T_B/2$ in succession and, hence, successively dispersed drive based upon "a shift by 16 divisions" can be performed without impact deviation. In other words, according to this embodiment, successively dispersed drive without any impact deviation is possible over a broad range of driving frequencies.

The construction of the apparatus according to the second embodiment is the same as that shown in FIG. 11. However, the signal control circuit 7 in the second embodiment outputs a six-bit block drive signal. This consists of two three-bit signals which are outputted after an intervening delay time decided by the printing mode (the HQ mode or HS mode) set at the time.

OTHER EMBODIMENTS

Figure 5:
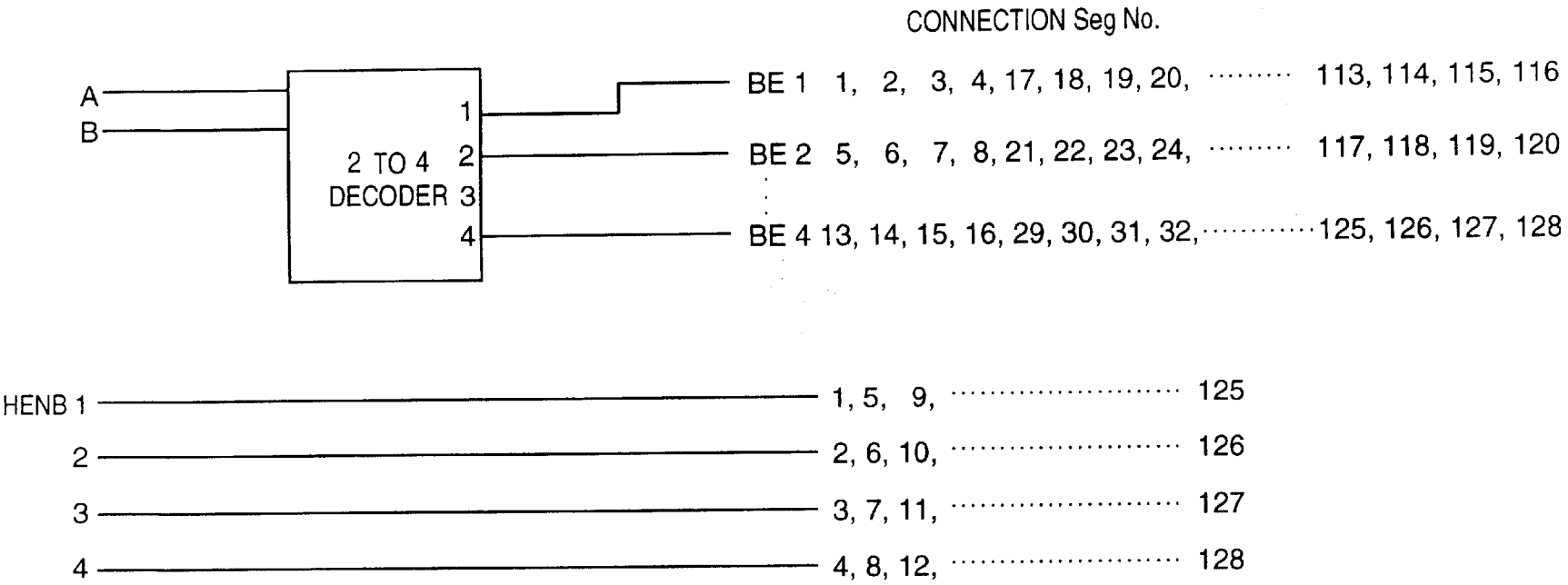
FIG. 5 is a diagram showing a circuit arrangement according to another embodiment of the present invention.

The embodiments described above are realized by the block-enable selection circuit and two HENB signals, namely the ODDENB and EVENENB signals. However, the HENB signals are not limited to two signals. FIG. 5 illustrates an embodiment in a case where there are four HENB signals.

In this embodiment, the number of nozzles is 128, and therefore the apparatus is realized by a 2to4 decoder and four HENB signals HENB1~HENB4. At the low driving frequency, drive is performed without overlapping of the BENB signals in terms of time, as in the foregoing embodiments. At the high driving frequency, however, "shifted time-division" drive is performed.

Figure 6:
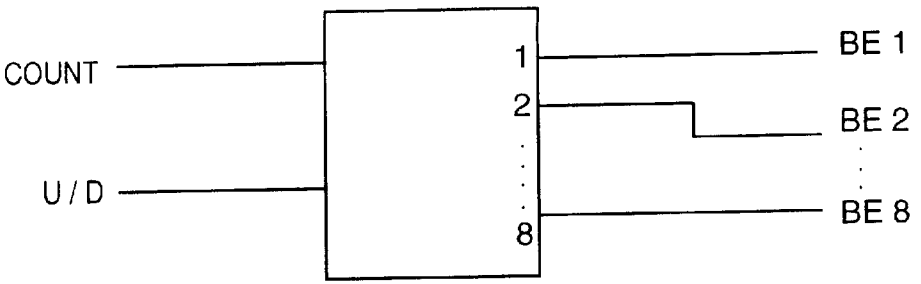
FIG. 6 is a diagram showing a circuit arrangement according to another embodiment of the present invention.
Figure 7:
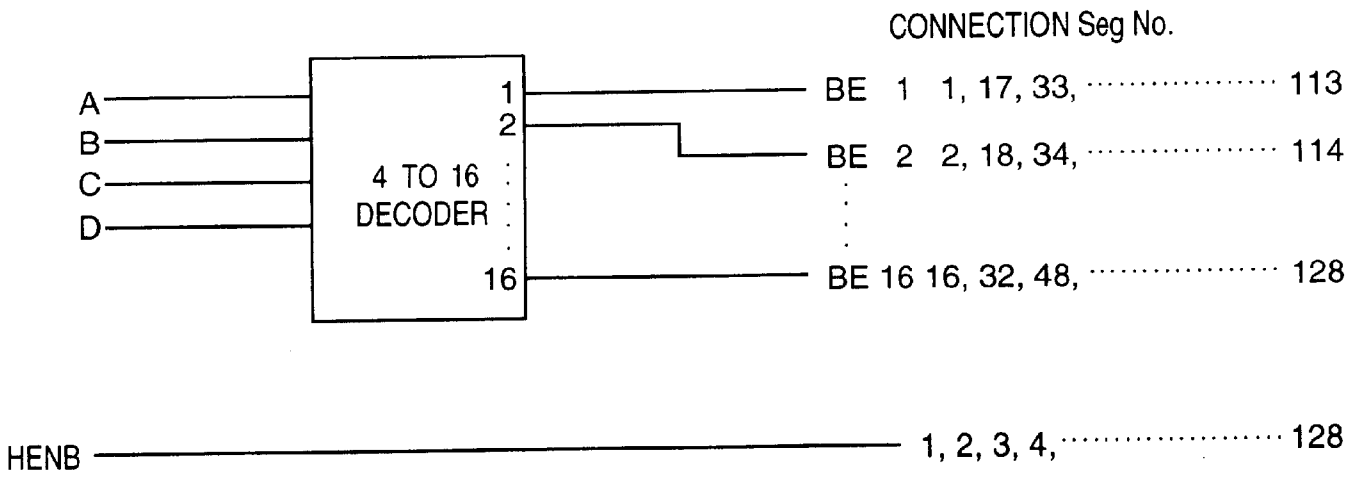
FIG. 7 is a diagram showing a circuit arrangement according to the prior art.

In the embodiments set forth above, an example is described in which a 2to4 decoder is used as the block-enable selection decoder circuit. However, the range of application of this embodiment is not limited to this. FIG. 6 illustrates an example in which an up/down counter is used as the block-enable selection circuit. In this circuit, BE1~BE8 (or BE8~BE1) are selected successively by applying count pulses to a count input terminal. Whether BE1 ~BE8 or BE8~BE1 are selected depending upon the printing direction. That is, the selection is made by a U/D signal.

Though an ink-jet printer is described as an example of the printing apparatus above, this does not impose a limitation upon the present invention. The invention is applicable to all types of printing apparatus, such as those having a thermal-transfer head, a wire-dot hammer head, etc.

However, the present invention is especially effective when applied to a printing apparatus equipped with a head having a large number of recording elements (the segments or nozzles mentioned in the above-described embodiments) arranged with a very small spacing between them (which signifies a high resolution). Accordingly, it is preferred that the present invention be applied to an ink-jet printer capable of implementing high-resolution printing, as in the foregoing embodiments. (An apparatus of the type which discharges ink drops by thermal energy is particularly preferred since a high resolution is obtained with such an apparatus.)

Figure 12:
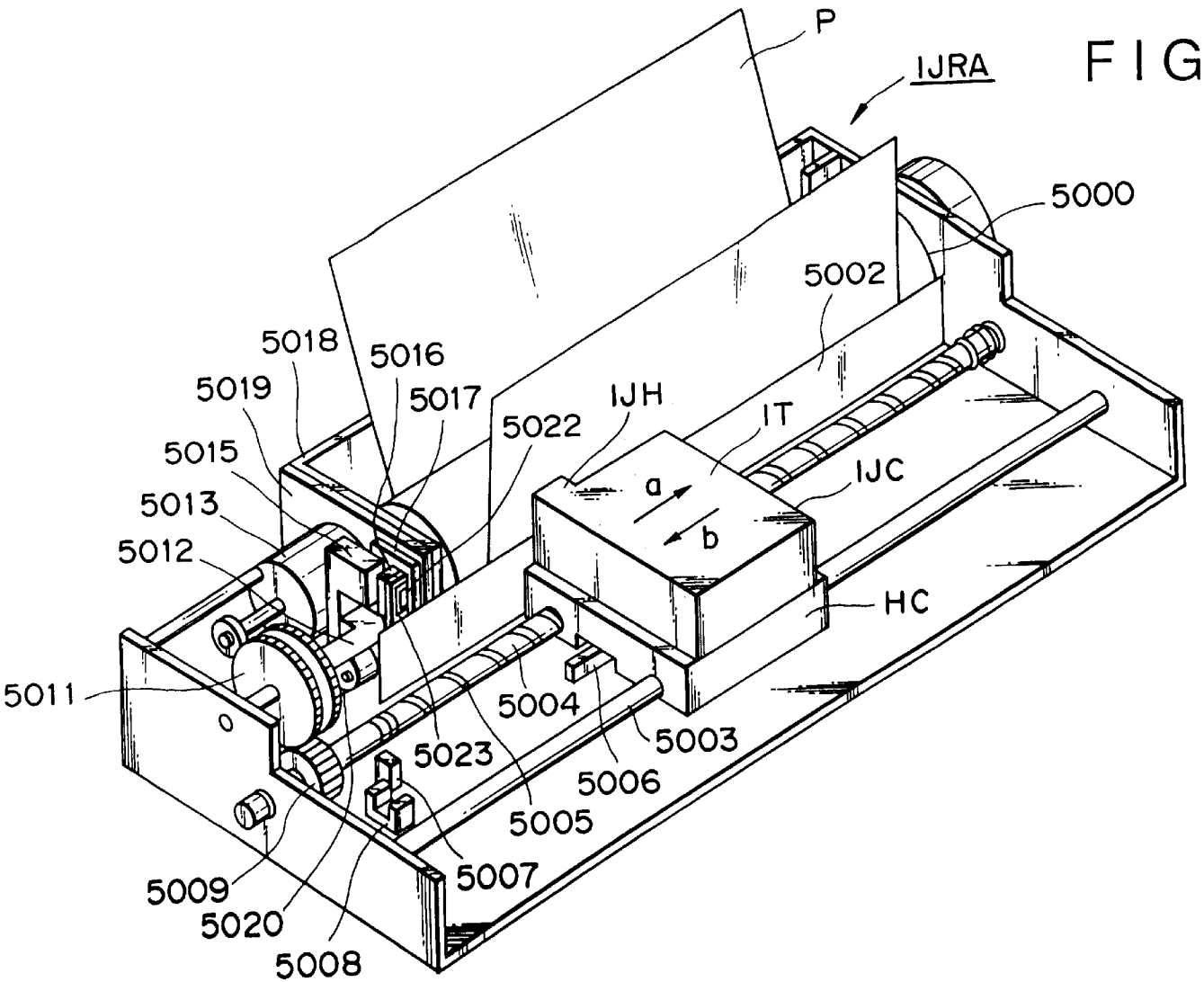
FIG. 12 is a perspective view showing a printer mechanism in a printing apparatus according to the general embodiment.

FIG. 12 illustrates a hand-held printer to which the apparatus of the embodiment is applied.

Specifically, FIG. 12 is an external perspective view showing general construction of an ink-jet printer IJRA. In FIG. 12, a lead screw 5005 is rotated via driving-force transmission gears 5011, 5009 in operative association with the forward-reverse rotation of a drive motor 5013. A carriage HC engaged with a helical groove 5004 formed in the lead screw 5005 has a pin (not shown) and is moved back and forth in the directions of arrows a, b. An integrated ink-jet cartridge IJC, which has an internally provided recording head IJH and an ink tank IT, is mounted on the carriage HC. A paper retaining plate 5002 presses a sheet of paper against a platen 5000 along the direction in which the carriage HC moves. Photocouplers 5007, 5008 serve as home-position sensing means for sensing the presence of a lever 5006 provided on the carriage HC in order to change over the direction of rotation of a motor 5013. Numeral 5016 denotes a member supporting a cap member 5022 which caps the front side of the recording head IJH, and numeral 5015 denotes a suction device for producing suction inside the cap to restore the recording head 12 by suction recovery via an opening 5023 inside the cap. Numeral 5017 denotes a cleaning blade and 5019 a member which makes it possible to move the blade back and forth. These are supported on a supporting plate 5018. It goes without saying that the blade applied to this example is not limited to the illustrated blade but can be any well-known cleaning blade. Numeral 5021 denotes a lever for starting the starting the suction operation in suction recovery. The lever 5021 moves to accompany movement of a cam 5020 engaged with the carriage, and the movement thereof is controlled by well-known transmission means such as a clutch for changing over the driving force from the driving motor.

These capping, cleaning and suction recovery operations are carried out by executing the desired processing at corresponding positions through the action of the lead screw 5005 when the carriage HC has arrived in an area on the side of the home position. If the desired operations are performed at the well-known timing, these operations can be applied to this example.

In accordance with the embodiments as described above, a circuit which divides nozzles into a plurality of blocks and subjects the block to time-division drive is provided with a block-enable selection decoder and a plurality of HENB signals. As a result, the number of time divisions in time-division drive can be changed in dependence upon the driving frequency of the head, and "shifted time-division drive" is made possible. Accordingly, it is possible to design for voltage drop and power supply with fewer driver currents (simultaneously driven nozzles). As a result, the recording apparatus can be made small in size and low in cost. Further, since the inclination of the head at the time of successively dispersed drive can be made small, there is no decline in reliability in a recording apparatus of the exchangeable head type and there is no need for a complicated contact design. Furthermore, by adopting "shifted time-division drive", successively dispersed drive with no (little) deviation in impact position due to drive can be achieved.

Thus, in accordance with the present invention, it is possible to record a high-quality image that corresponds to the scanning speed of the recording head. This can be achieved through a simple arrangement.

As many apparently widely different embodiments of the present invention can be made without departing from the spirit and scope thereof, it is to be understood that the invention is not limited to the specific embodiments thereof except as defined in the appended claims.

What is claimed is:

1. A recording apparatus for recording an image by moving a recording head in a main-scanning direction, said recording head having a plurality of recording elements, said plurality of recording elements being arranged at a predetermined angle of inclination in said main-scanning direction and divided into a plurality of groups, a number of which said groups corresponds to a number of a plurality of recording column positions, a plurality of dots corresponding to respective said recording column positions being recorded by each said group, said apparatus comprising:

scanning means for scanning said recording head at a speed corresponding to a selected mode of at least two modes, one mode for scanning said recording head at a first speed, the other mode for scanning said recording head at a second speed higher than said first speed;

signal supply means for dividing recording elements of each group into a plurality of blocks to be driven at the same time, and for supplying drive signals to each block; and means for changing the number of blocks, which are supplied by said signal supply means, based upon the scanning speed of the recording head in selected mode.

2. The apparatus according to claim 1, wherein said drive signals comprise a first signal corresponding to said unit of drive composed of odd-numbered said recording elements in each said block and a second signal corresponding to said unit of drive composed of even-numbered said recording elements in each said block.

3. The apparatus according to claim 1, wherein the scanning speed of said recording head is set externally.

4. The apparatus according to claim 1, wherein said recording elements jet drops of an ink using thermal energy.

5. The recording apparatus according to claim 1, wherein said signal supply means comprises:

first signal supply means for sequentially supplying a block enable signal for one block; and second signal supply means for, while said first signal supply is supplying a block enable signal for one block, supplying two drive signals, one being for driving odd recording elements in said recording head, the other being for driving even recording elements in said recording head, said recording apparatus further comprising:

masking means for masking image data with a predetermined zigzag pattern when printing is performed in said high speed mode;

wherein said second signal supply means supplies said two drive signals alternately in said normal speed, while said second signal supply means supplies said two drive signals so that said two drive signals overlap each other.

6. The apparatus according to claim 1, wherein the divided number of blocks decreases as the scanning speed increases.

7. A recording method for recording an image by moving a recording head in a main-scanning direction, said recording head having a plurality of recording elements, said plurality of recording elements being arranged at a predetermined angle of inclination in said main-scanning direction and divided into a plurality of groups, a number of which said groups corresponds to a number of a plurality of recording column positions, a plurality of dots corresponding to each said group, said method comprising:

a step of scanning said recording head at a speed corresponding to a selected mode of at least two modes, one mode for scanning said recording head at a first speed, the other mode for scanning said recording head at a second speed higher than said first speed;

a step of dividing recording elements of each group into a plurality of blocks to be driven at the same time, and for supplying drive signals to each block; and a step of changing the number of blocks based upon the scanning speed of the recording head in the selected mode.

8. The method according to claim 7, wherein said drive signals comprise a first signal corresponding to said unit of drive composed of a group of odd-numbered said recording elements in each said block and a second signal corresponding to said unit of drive composed of even-numbered said recording elements in each said block.

9. The method according to claim 7, wherein the scanning speed of said recording head is set externally.

10. The method according to claim 7, wherein said recording elements jet drops of an ink using by thermal energy.

11. The method according to claim 7, wherein the divided number of blocks decreases as the scanning speed increases.

12. A recording-head drive circuit for driving an array of a plurality of recording elements disposed in a plurality of block units, the array of recording elements being arranged at an incline with respect to a scanning direction of said recording head, and spanning a plurality of recording column positions, the recording elements being divided into a plurality of groups, a number of the groups corresponding to a number of recording column positions, each said block unit having a plurality of said recording elements at a same phase of the groups, said drive circuit comprising:

a scanning circuit for scanning said recording head at a speed corresponding to a selected mode of at least two modes, one mode for scanning said recording head at a first speed, the other mode for scanning said recording head at a second speed higher than said first speed;

a selecting circuit for selecting the plurality of block units in an order; and a designating circuit, which is shared by the block units, for designating each of the recording element groups in each said block, wherein said recording elements in a block unit selected by said selecting circuit are further divided into a plurality of blocks based on the selected mode.

13. The circuit according to claim 12, wherein said selecting circuit comprises a decoder circuit for outputting a plurality of block selection signals in response to a prescribed number of input signals, the number of the block selection signals being greater than said prescribed predetermined number.

14. The circuit according to claim 12, wherein said selecting circuit comprises a counter circuit for counting an input signal and outputting a block selection signal for selecting from said block units in order in dependence upon a counted value.

15. The circuit according to claim 12, wherein said counter circuit chances over the order in which said block units are selected.

16. The circuit according to claim 12, wherein said designating circuit outputs a designating signal for designating a group of odd-numbered said recording elements of each said block unit, and a designating signal for designating a group of even-numbered said recording elements of each said block unit.

17. The circuit according to claim 12, wherein said recording elements generate energy to discharge ink drops.

18. The circuit according to claim 17, wherein said recording elements comprise elements for generating thermal energy, and the ink drops are discharged as the thermal energy produces a change in a state of the ink.

19. A recording head which is scanned at a speed corresponding to a scanning mode of at least two modes, comprising:

an array of a plurality of recording elements disposed in a plurality of block units, the array of recording elements being arranged at an incline with respect to a scanning direction of said recording head, and spanning a plurality of recording column positions, the recording elements being divided into a plurality of groups, a number of the groups corresponding to a number of recording column positions, each said block unit having a plurality of said recording elements at the same phase of the groups;

a selecting circuit for dividing said plurality of recording elements into the plurality of block units and for selecting resulting said block units in an order;

a designating circuit, which is shared by the block units, for designating each of the recording element groups in each said block unit; and a drive circuit for driving, in a selected mode, a given said group of said recording elements, designated by said designating circuit, in a given said block unit selected by said selecting circuit, wherein said recording elements in a block unit selected by said selecting circuit are further divided into a plurality of blocks based on the selected mode.

20. The recording according to claim 19, wherein said selecting circuit comprises a decoder circuit for outputting a plurality of block selection signals in response to a prescribed number of input signals, the number of the block selection signals being greater than said prescribed number.

21. The recording head according to claim 19, wherein said selecting circuit comprises a counter circuit for counting an input signal and outputting a block selection signal for selecting from said block units in the order in dependence upon a counted value.

22. The recording head according to claim 21, wherein said counter circuit changes over the order in which said block units are selected.

23. The recording head according to claim 19, wherein said designating circuit outputs a designating signal for designating a group of odd-numbered said recording elements of each said block unit, and a designating signal for designating a group of even-numbered said recording elements of each said block unit.

24. The recording according to claim 19, wherein said recording elements generate energy to discharge ink drops.

25. The circuit according to claim 24, wherein said recording elements comprise elements for generating thermal energy, and the ink drops are discharged as the thermal energy produces a change in a state of the ink.

26. A recording apparatus for recording an image by moving a recording head in a main-scanning direction, said recording head having a plurality of recording elements, said plurality of recording elements being arranged at a predetermined angle of inclination in said main-scanning direction and divided into a plurality of groups, a number of groups corresponding to a number of a plurality of recording column positions, a plurality of dots corresponding to respective said recording column positions being recorded by said each said group, said apparatus comprising:

scanning means for scanning said recording head at a speed corresponding to a selected mode of at least two modes, one mode for scanning said recording head at a first speed, the other mode for scanning said recording head at a second speed higher than said first speed;

signal supply means for dividing recording elements of each group into a plurality of blocks to be driven at the same time, and for supplying drive signals to each block; and means for changing each frequency of the drive signals for driving the blocks, which are supplied by said signal supply means, based upon the scanning speed of the recording head in selected mode.

27. A recording method for recording an image by moving a recording head in a main-scanning direction, said recording head having a plurality of recording elements, said plurality of recording elements being arranged at a predetermined angle of inclination in said main-scanning direction and divided into a plurality of groups, a number of which said groups corresponds to a number of a plurality of recording column positions, a plurality of dots corresponding to each said group, said method comprising:

a step of scanning said recording head at a speed corresponding to a selected mode of at least two modes, one mode for scanning said recording head at a first speed, the other mode for scanning said recording head at a second speed higher than said first speed;

a step of dividing recording elements of each group into a plurality of blocks to be driven at the same time, and for supplying driving signals to each block; and a step of changing each frequency of the driving signals for driving the blocks based upon the scanning speed of the recording head in the selected mode.

* * * * *

UNITED STATES PATENT AND TRADEMARK OFFICE

CERTIFICATE OF CORRECTION

PATENT NO. : 6,126,261

DATED : October 3, 2000

INVENTOR : AKIHIRO YAMANAKA

It is certified that error appears in the above-identified patent and that said Letters Patent is hereby corrected as shown below:

COVER PAGE

Under [57] Abstract, line 7, "made" should read --make--.

IN THE DRAWINGS

Sheet 10, Figure 11, "CONTORL" should read --CONTROL--.

COLUMN 1

Line 49, "blockenable" should read --block-enable--.

COLUMN 3

Line 2, "TB," should read --$T_B$,--.

COLUMN 14

Line 47, "by" should be deleted.

COLUMN 15

Line 19, "chances" should read --changes--.

UNITED STATES PATENT AND TRADEMARK OFFICE

CERTIFICATE OF CORRECTION

PATENT NO. : 6,126,261

DATED : October 3, 2000

INVENTOR : AKIHIRO YAMANAKA

It is certified that error appears in the above-identified patent and that said Letters Patent is hereby corrected as shown below:

COLUMN 16

Line 29, "said" (first occurrence), should be deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*